US008915698B2

(12) United States Patent
Jeon et al.

(10) Patent No.: US 8,915,698 B2
(45) Date of Patent: Dec. 23, 2014

(54) TURBOFAN OF AIR CONDITIONING SYSTEM

(75) Inventors: Hyun Joo Jeon, Hwaseong-si (KR); Seon Uk Na, Yongin-si (KR); Jun Gwan Park, Suwon-si (KR); Yong Hun Kang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 315 days.

(21) Appl. No.: 13/366,725

(22) Filed: Feb. 6, 2012

(65) Prior Publication Data

US 2012/0213637 A1 Aug. 23, 2012

(30) Foreign Application Priority Data

Feb. 22, 2011 (KR) ..... 10-2011-0015566

(51) Int. Cl.
*F04D 29/28* (2006.01)
*F04D 29/66* (2006.01)
*F04D 29/16* (2006.01)

(52) U.S. Cl.
CPC ..... *F04D 29/162* (2013.01)
USPC ..... 415/58.3; 415/58.4; 415/119; 416/186 R

(58) Field of Classification Search
CPC ..... F04D 27/0207; F04D 27/0238; F04D 29/162; F04D 29/685; F04D 29/4213
USPC ..... 415/58.2–58.4, 119, 228; 416/185, 416/186 R, 188, 223 B
See application file for complete search history.

(56) References Cited

U.S. PATENT DOCUMENTS

| | | | | |
|---|---|---|---|---|
| 4,432,694 | A * | 2/1984 | Kuroda et al. | 416/186 R |
| 2002/0106277 | A1 | 8/2002 | Chapman | |
| 2003/0002986 | A1 * | 1/2003 | Pauly | 416/186 R |
| 2005/0226721 | A1 * | 10/2005 | Higashida | 415/206 |
| 2008/0118345 | A1 * | 5/2008 | Choi et al. | 415/58.4 |

FOREIGN PATENT DOCUMENTS

| | | |
|---|---|---|
| JP | 2005-156040 | 6/2005 |
| JP | 2007-162467 | 6/2007 |
| KR | 10-2006-0081223 | 7/2006 |

* cited by examiner

*Primary Examiner* — Christopher Verdier
(74) *Attorney, Agent, or Firm* — Staas & Halsey LLP

(57) ABSTRACT

A turbofan of an air conditioning system in which a shroud is divided into two portions to form an air passage, in order to allow, when a portion of turbulent air generated at an upper portion of the shroud is reintroduced into a space between a bell mouse and the shroud by a pressure difference, the reintroduced air to be distributed throughout the air passage. The turbofan of the air conditioning system includes a first shroud formed with an air inlet hole, a second shroud formed to be spaced outwards from the first shroud so that an air passage is formed between the first and second shrouds, a hub to rotate through a rotational shaft of a drive motor, and a plurality of blades to guide air introduced through the air inlet hole in the circumferential direction of the hub.

23 Claims, 9 Drawing Sheets

TURBOFAN OF AIR CONDITIONING SYSTEM

CROSS-REFERENCE TO RELATED APPLICATIONS

This application claims the benefit of Korean Patent Application No. 10-2011-0015566 filed on Feb. 22, 2011 in the Korean Intellectual Property Office, the disclosure of which is incorporated herein by reference in its entirety.

BACKGROUND

1. Field

Embodiments of the present disclosure relate to a turbofan of an air conditioning system to divide a shroud into a plurality of portions in order to reduce the generation of noise.

2. Description of the Related Art

In general, a turbofan is installed in an air conditioning system such as a refrigerator or an air conditioner to forcibly circulate air.

The turbofan of the air conditioning system includes a shroud having a ring shape, a hub to rotate about an axis thereof through a rotational shaft of a drive motor, and a plurality of blades spaced apart from one another by a predetermined clearance along a circumferential direction of the hub.

Air introduced through a bell mouth flows into the turbofan of the air conditioning system through an air inlet hole formed at the shroud. Subsequently, the air introduced into the turbofan of the air conditioning system flows in an axial direction of the hub, and then flows in the circumferential direction of the hub by rotation of the blades so as to be introduced into a heat exchanger.

During flow of air as described above, turbulent air may be inevitably generated at an upper portion of the shroud due to various factors, for example, a difference in lengths of the heat exchanger and each blade and a position of a discharge port of the heat exchanger.

A portion of the turbulent air generated at the upper portion of the shroud may be reintroduced into a space between the bell mouth and the shroud, thereby disturbing an air flow in the turbofan of the air conditioning system. As a result, noise may be generated.

SUMMARY

Therefore, it is an aspect of the present disclosure to provide a turbofan of an air conditioning system in which a shroud is divided into two portions to form an air passage, in order to allow, when a portion of turbulent air generated at an upper portion of the shroud is reintroduced into a space between a bell mouth and the shroud by a pressure difference, the reintroduced air to be distributed throughout the air passage.

Additional aspects of the disclosure will be set forth in part in the description which follows and, in part, will be apparent from the description, or may be learned by practice of the disclosure.

In accordance with one aspect of the present disclosure, a turbofan of an air conditioning system includes a first shroud formed with an air inlet hole, the first shroud having a ring shape, a second shroud formed to be radially spaced outwards from the first shroud by a predetermined clearance so that an air passage is formed between the first and second shrouds, a hub to rotate about an axis thereof through a rotational shaft of a drive motor, and a plurality of blades formed to be spaced apart from one another by a predetermined clearance along a circumferential direction of the hub to guide air introduced through the air inlet hole in the circumferential direction of the hub.

Each of the first and second shrouds may be coupled with a portion of an upper surface of each blade.

The first shroud may include a first guide portion to guide air introduced through the air inlet hole in an axial direction of the hub, and a second guide portion to guide air introduced through the air inlet hole in the circumferential direction of the hub.

The second shroud may include an inducing portion corresponding to the second guide portion of the first shroud to define the air passage along with the second guide portion, the inducing portion conducting air introduced into the air passage in the circumferential direction of the hub.

An upper end of the inducing portion in the second shroud may have a lower height than an upper end of the second guide portion in the first shroud.

The second shroud may include an extending portion corresponding to the first guide portion of the first shroud to define the air passage along with the first guide portion, and an inducing portion corresponding to the second guide portion of the first shroud to define the air passage along with the second guide portion, the inducing portion conducting air introduced into the air passage in the circumferential direction of the hub.

An upper end of the extending portion in the second shroud may have the same height as an upper end of the first guide portion in the first shroud, and an upper end of the inducing portion in the second shroud has a lower height than an upper end of the second guide portion in the first shroud.

The air passage may have a ring shape.

A portion of the reintroduced air may be introduced into the air passage formed between the first and second shrouds when air is reintroduced into the air inlet hole by turbulent flows while being guided in the circumferential direction of the hub by the blades after being introduced through the air inlet hole.

The hub may include a base which is coupled with a portion of a lower surface of each blade, and a protrusion portion to which the rotational shaft of the drive motor is fixed.

Each of the blades may have a plate shape perpendicular to the first shroud, second shroud, and hub.

The blade may be formed to extend in a spiral direction with respect to a rotational center of the hub.

In accordance with another aspect of the present disclosure, a turbofan of an air conditioning system includes a shroud having a ring shape, a hub to rotate about an axis thereof through a rotational shaft of a drive motor, and a plurality of blades formed to be spaced apart from one another by a predetermined clearance along a circumferential direction of the hub, wherein the shroud includes a first shroud formed with an air inlet hole, a second shroud formed to be radially spaced outwards from the first shroud by a predetermined clearance so that a first air passage is formed between the first and second shrouds, and a third shroud formed to be radially spaced outwards from the second shroud by a predetermined clearance so that a second air passage is formed between the second and third shrouds.

Each of the first, second, and third shrouds may be coupled with a portion of an upper surface of each blade.

The first shroud may include a first guide portion to guide air introduced through the air inlet hole in an axial direction of the hub, and a second guide portion to guide air introduced through the air inlet hole in the circumferential direction of the hub.

The second shroud may include a first inducing portion corresponding to the second guide portion of the first shroud to define the first air passage along with the second guide portion, the first inducing portion conducting air introduced into the first air passage in the circumferential direction of the hub.

The third shroud may include a second inducing portion corresponding to the first inducing portion of the second shroud to define the second air passage along with the first inducing portion, the second inducing portion conducting air introduced into the second air passage in the circumferential direction of the hub.

An upper end of the first inducing portion in the second shroud may have a lower height than an upper end of the second guide portion in the first shroud.

An upper end of the second inducing portion in the third shroud may have a lower height than an upper end of the first inducing portion in the second shroud.

Each of the first and second air passages may have a ring shape.

A portion of the reintroduced air may be introduced into the first air passage formed between the first and second shrouds and the second air passage formed between the second and third shrouds when air is reintroduced into the air inlet hole by turbulent flows while being guided in the circumferential direction of the hub by the blades after being introduced through the air inlet hole.

The hub may include a base which is coupled with a portion of a lower surface of each blade, and a protrusion portion to which the rotational shaft of the drive motor is fixed.

Each of the blades may have a plate shape perpendicular to the first shroud, second shroud, third shroud, and hub.

The blade may be formed to extend in a spiral direction with respect to a rotational center of the hub.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
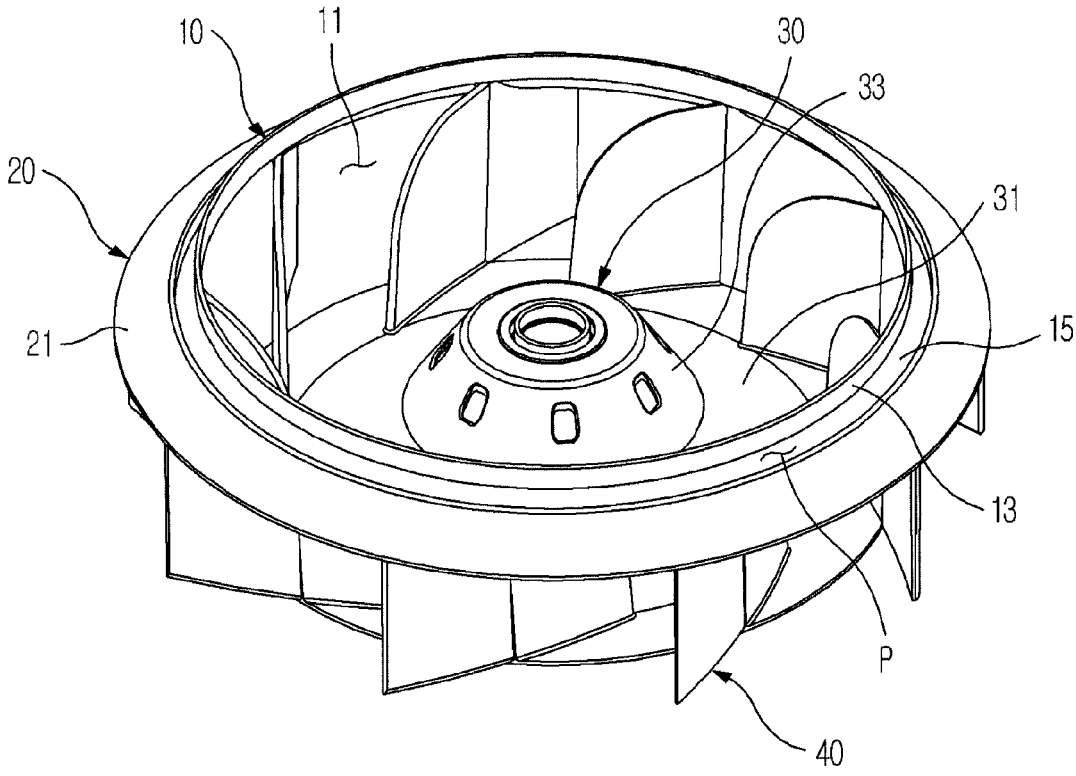
FIG. 1 is a perspective view illustrating a turbofan of an air conditioning system according to an exemplary embodiment of the present disclosure.

Reference will now be made in detail to the embodiments of the present disclosure, examples of which are illustrated in the accompanying drawings, wherein like reference numerals refer to like elements throughout.

Figure 2:
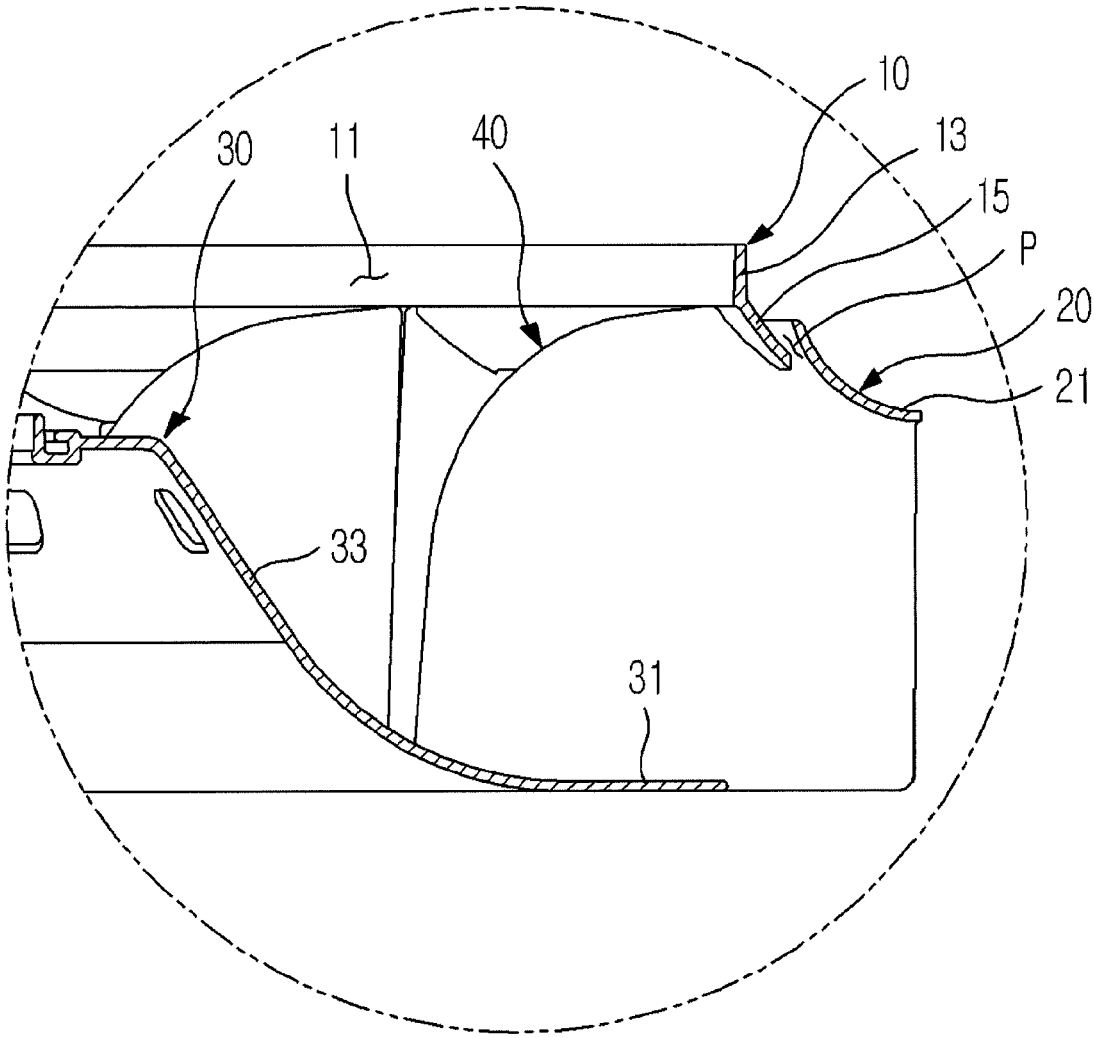
FIG. 2 is a sectional view illustrating the turbofan of the air conditioning system according to an exemplary embodiment of the present disclosure.
Figure 3A:
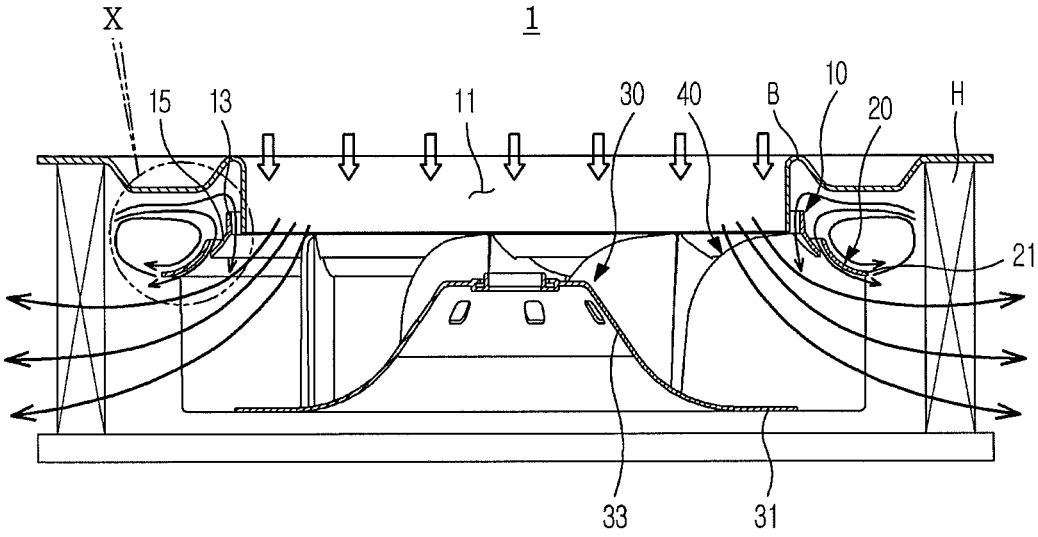
FIGS. 3A and 3B are a sectional view and an enlarged partial view "X" illustrating an air flow in the turbofan of the air conditioning system according to an exemplary embodiment of the present disclosure.
Figure 3B:
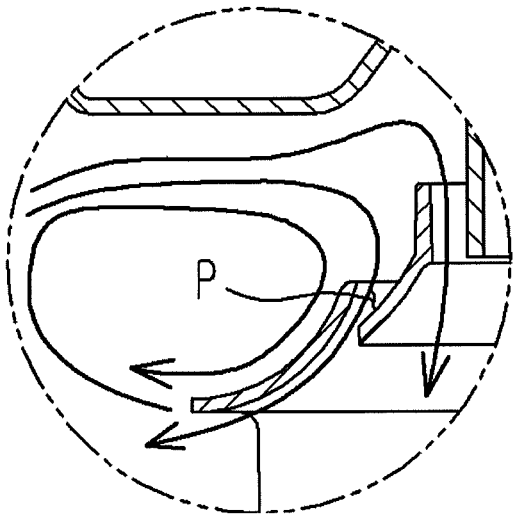
Figure 4:
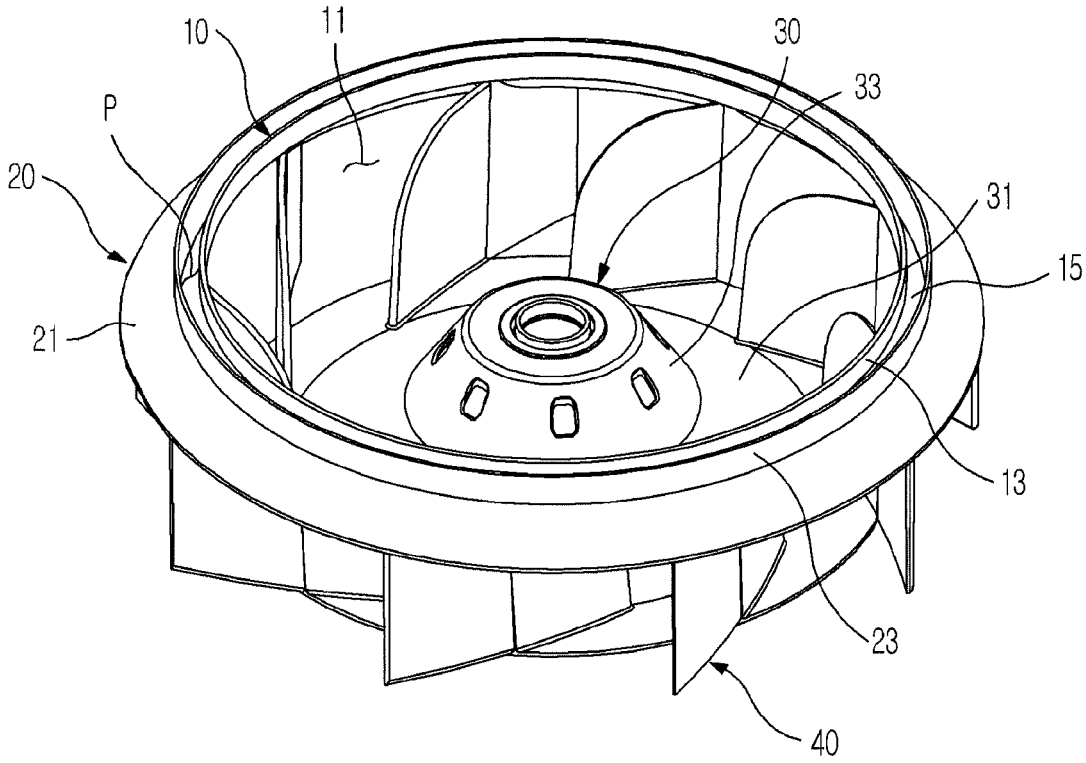
FIG. 4 is a perspective view illustrating a turbofan of an air conditioning system according to another exemplary embodiment of the present disclosure.
Figure 5:
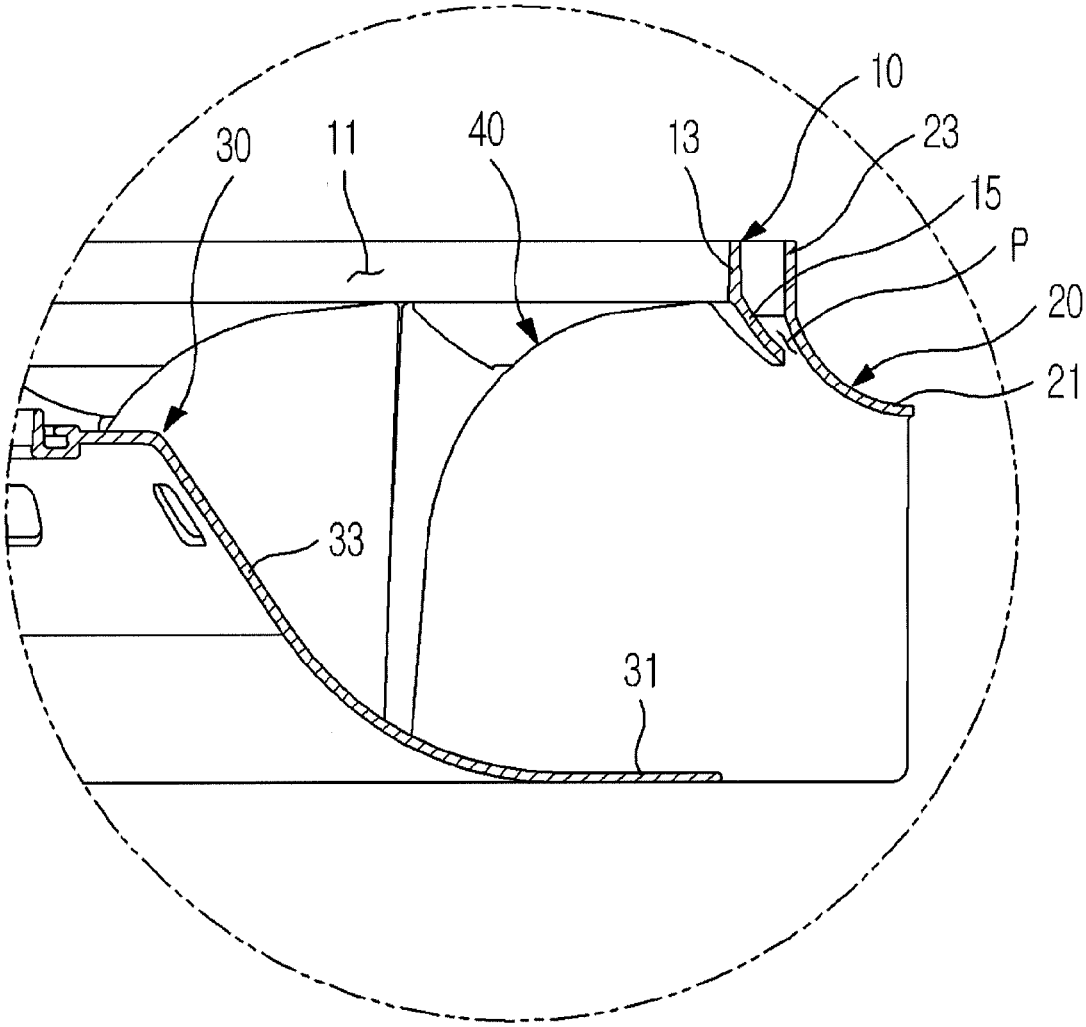
FIG. 5 is a sectional view illustrating the turbofan of the air conditioning system according to another exemplary embodiment of the present disclosure.
Figure 6A:
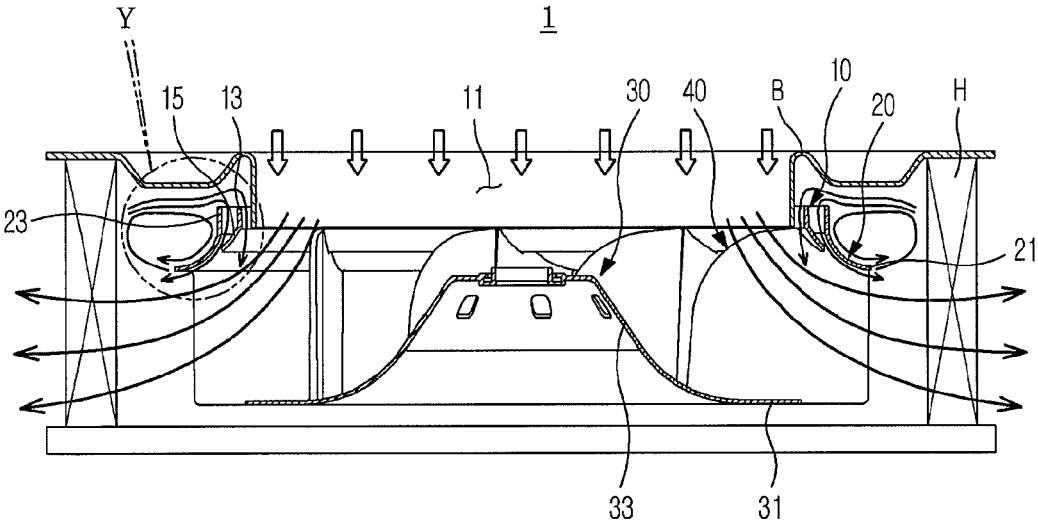
FIGS. 6A and 6B are a sectional view and an enlarged partial view "Y" illustrating an air flow in the turbofan of the air conditioning system according to another exemplary embodiment of the present disclosure.
Figure 6B:
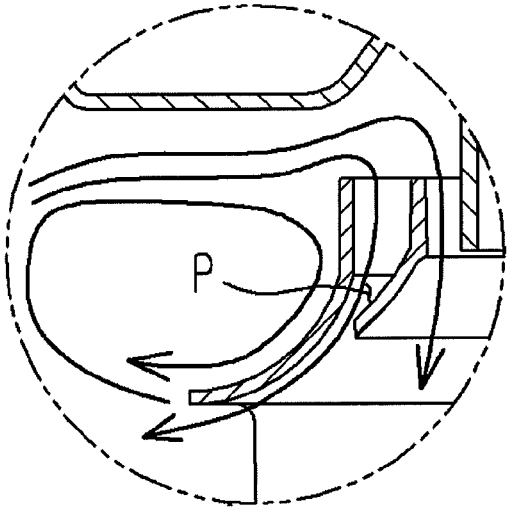

FIG. 1 is a perspective view illustrating a turbofan of an air conditioning system according to an exemplary embodiment of the present disclosure. FIG. 2 is a sectional view illustrating the turbofan of the air conditioning system according to the illustrated embodiment of the present disclosure. FIGS. 3A and 3B are a sectional view and an enlarged partial view "X" illustrating an air flow in the turbofan of the air conditioning system according to the illustrated embodiment of the present disclosure.

As shown in FIGS. 1 to 3B, the turbofan of the air conditioning system, which is designated by reference numeral 1, includes a first shroud 10, a second shroud 20, a hub 30, and a plurality of blades 40. The first shroud 10 has a ring shape and is formed with an air inlet hole 11. The second shroud 20 is formed to be radially spaced outwards from the first shroud 10 by a predetermined clearance so that an air passage P is formed between the first and second shrouds 10 and 20. The hub 30 rotates about an axis thereof through a rotational shaft (not shown) of a drive motor (not shown). The blades 40 are formed to be spaced apart from one another by a predetermined clearance along a circumferential direction of the hub 30 to guide air introduced through the air inlet hole 11 in the circumferential direction of the hub 30.

As shown in FIGS. 1 to 3B, the first shroud 10 has a ring shape. The first shroud 10 is formed, at a central area thereof, with the air inlet hole 11. The air inlet hole 11 has a circular shape.

Air introduced through a bell mouth B flows into the turbofan 1 of the air conditioning system through the air inlet hole 11 formed at the first shroud 10.

The first shroud 10 includes a first guide portion 13 and a second guide portion 15. The first guide portion 13 is formed in a direction perpendicular to a base 31 of the hub 30 described below to guide air introduced through the air inlet hole 11 in an axial direction of the hub 30. The second guide portion 15 is coupled with a portion of an upper surface of each blade 40 described below to guide air introduced through the air inlet hole 11 in the circumferential direction of the hub 30.

Air introduced through the air inlet hole 11 is guided in the axial direction of the hub 30 by the first guide portion 13 of the first shroud 10. Subsequently, the air guided in the axial direction of the hub 30 flows in the circumferential direction of the hub 30 by rotation of the blades 40, and is then guided to a heat exchanger H by the second guide portion 15 of the first shroud 10.

As shown in FIGS. 1 to 3B, the second shroud 20 is formed to be radially spaced outwards from the first shroud 10 by a predetermined clearance.

Since the second shroud 20 is formed to be spaced apart from the first shroud 10 by a predetermined clearance, as described above, the air passage P is formed at a space between the first and second shrouds 10 and 20.

The air passage P has the same ring shape as the first and second shrouds 10 and 20.

The second shroud 20 includes an inducing portion 21 corresponding to the second guide portion 15 of the first shroud 10 to define the air passage P along with the second guide portion 15. The inducing portion 21 conducts air introduced into the air passage P in the circumferential direction of the hub 30.

The inducing portion 21 included in the second shroud 20 is coupled with a portion of the upper surface of each blade 40.

Air introduced through the air inlet hole 11 of the first shroud 10 is guided in the axial direction of the hub 30 by the first guide portion 13 of the first shroud 10. Subsequently, the air guided in the axial direction of the hub 30 flows in the circumferential direction of the hub 30 by rotation of the blades 40, and is then guided to the heat exchanger H by the second guide portion 15 and the inducing portion 21 of the respective first and second shrouds 10 and 20.

A portion of air to be guided to the heat exchanger H is not guided to the heat exchanger H due to various factors, for example, a difference in lengths of the heat exchanger H and each blade 40 and a position of a discharge port of the heat exchanger H, but flows toward upper portions of the first and second shrouds 10 and 20, thereby generating turbulent flows of air.

A portion of turbulent air generated at an upper portion of the first and second shrouds 10 and 20 is reintroduced into a space between the bell mouth B and the first shroud 10 by a pressure difference between air rapidly introduced through the bell mouth B and the turbulent air.

The air reintroduced into the space between the bell mouth B and the first shroud 10 may disturb an air flow which is guided to the heat exchanger H after being introduced through the air inlet hole 11 of the first shroud 10. This causes generation of noise.

In order to reduce such noise, it may be necessary to reduce the amount and velocity of air reintroduced into the space between the bell mouth B and the first shroud 10.

The second shroud 20 is formed to be spaced apart from the first shroud 10 by a predetermined clearance so that the air passage P is formed at the space between the first and second shrouds 10 and 20. In accordance with such a configuration, a portion of the air reintroduced into the space between the bell mouth B and the first shroud 10 flows into the air passage P. Accordingly, it may be possible to reduce the amount and velocity of air reintroduced into the space between the bell mouth B and the first shroud 10.

In other words, the air reintroduced into the space between the bell mouth B and the first shroud 10 is partially introduced into the air passage P, so that the amount and velocity of air reintroduced into the space between the bell mouth B and the first shroud 10 may be reduced.

The air introduced into the air passage P is conducted toward the heat exchanger H by the inducing portion 21 of the second shroud 20. As a result, the air flow is not disturbed while being guided to the heat exchanger H after being introduced through the air inlet hole 11 of the first shroud 10, thereby allowing the introduced air to flow smoothly toward the heat exchanger H.

An upper end of the inducing portion 21 has a lower height than an upper end of the second guide portion 15. Thus, air reintroduced into the space between the bell mouth B and the first shroud 10 may be smoothly introduced into the air passage P between the first and second shrouds 10 and 20.

As shown in FIGS. 1 to 3B, the hub 30 is placed at a central area of the turbofan 1 in the air conditioning system to rotate about an axis thereof through the rotational shaft (not shown) of the drive motor (not shown).

The hub 30 includes a base 31, which has a disk shape, coupled with a portion of a lower surface of each blade 40, and a protrusion portion 33 to which the rotational shaft of the drive motor is fixed.

When the drive motor is driven, the hub 30 rotates about an axis thereof through the rotational shaft of the drive motor. When the hub 30 rotates about an axis thereof, each blade 40 coupled to the base 31 of the hub 30 rotates about the protrusion portion 33 of the hub 30. Further, the first and second shrouds 10 and 20 coupled with each blade 40 also rotate about the protrusion portion 33 of the hub 30 during rotation of the blade 40.

As shown in FIGS. 1 to 3B, a plurality of blades 40 is formed to be spaced apart from one another by a predetermined clearance along the circumferential direction of the hub 30.

The upper surface of each blade 40 is partially coupled to both of the first and second shrouds 10 and 20, whereas the lower surface of the blade 40 is partially coupled to the base 31 of the hub 30.

The blade 40 may have a plate shape perpendicular to all of the first shroud 10, second shroud 20, and hub 30.

Further, the blade 40 may be formed to extend in a spiral direction with respect to a rotational center of the hub 30.

Each blade 40 is coupled to both of the first and second shrouds 10 and 20 to rotate together with the first and second shrouds 10 and 20.

The blade 40 forces air, which is guided in the axial direction of the hub 30 after being introduced through the air inlet hole 11 of the first shroud 10, to flow in the circumferential direction of the hub 30 by rotation of the blade 40.

The air flowing in the circumferential direction of the hub 30 is guided to the heat exchanger H by the second guide portion 15 and the inducing portion 21 of the respective first and second shrouds 10 and 20.

FIGS. 4 to 6B are views illustrating a modified structure of a second shroud in the turbofan of the air conditioning system according to an exemplary embodiment of the present disclosure.

The second shroud, which is designated by reference numeral 20, may include an extending portion 23 and an inducing portion 21. The extending portion 23 corresponds to the first guide portion 13 of the first shroud 10 to define an air passage P along with the first guide portion 13. The inducing portion 21 also corresponds to the second guide portion 15 of the first shroud 10 to define the air passage P along with the second guide portion 15. The inducing portion 21 conducts air introduced into the air passage P in the circumferential direction of the hub 30.

An upper end of the extending portion 23 may have the same height as an upper end of the first guide portion 13. An upper end of the inducing portion 21 may have a lower height than an upper end of the second guide portion 15.

Since the remaining configurations and the air flows, except for the configuration of the shroud 20 as described above, are the same as those according to the turbofan 1 of the air conditioning system shown in FIGS. 1 to 3B, no description will be given thereof.

Figure 7:
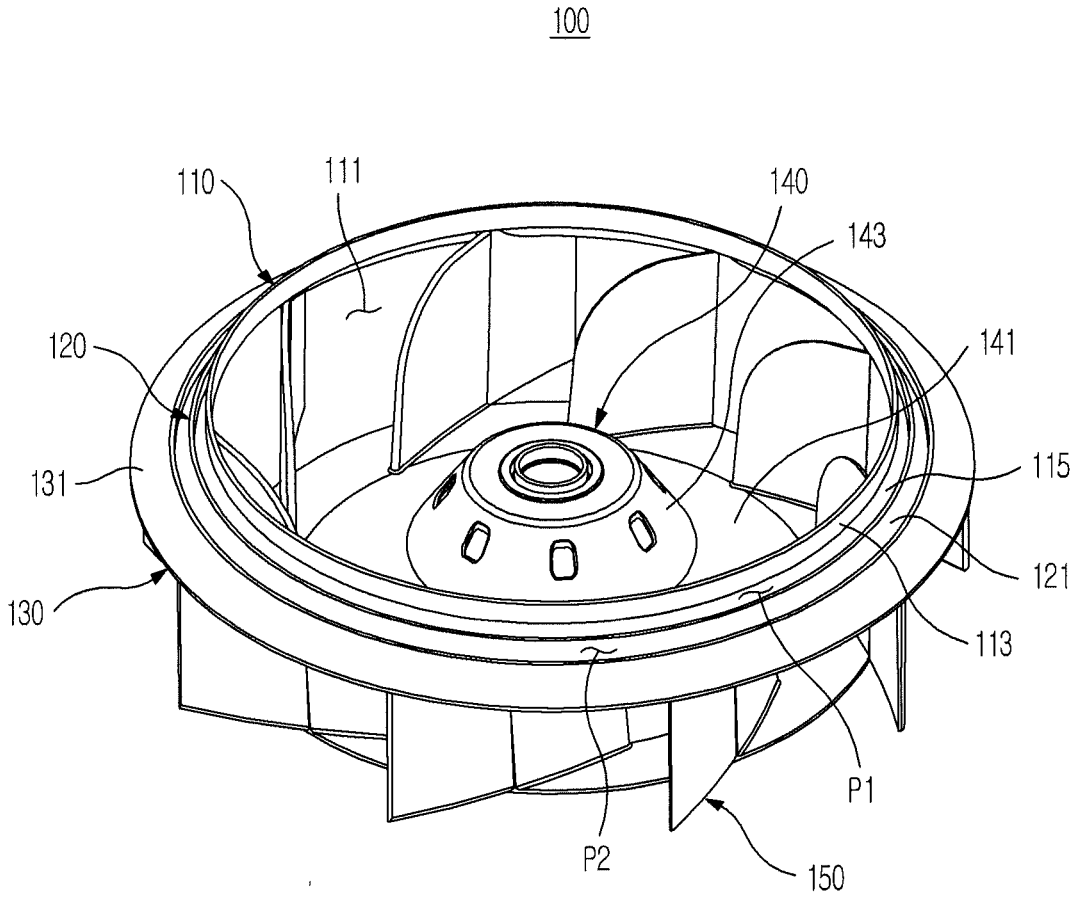
FIG. 7 is a perspective view illustrating a turbofan of an air conditioning system according to another exemplary embodiment of the present disclosure.
Figure 8:
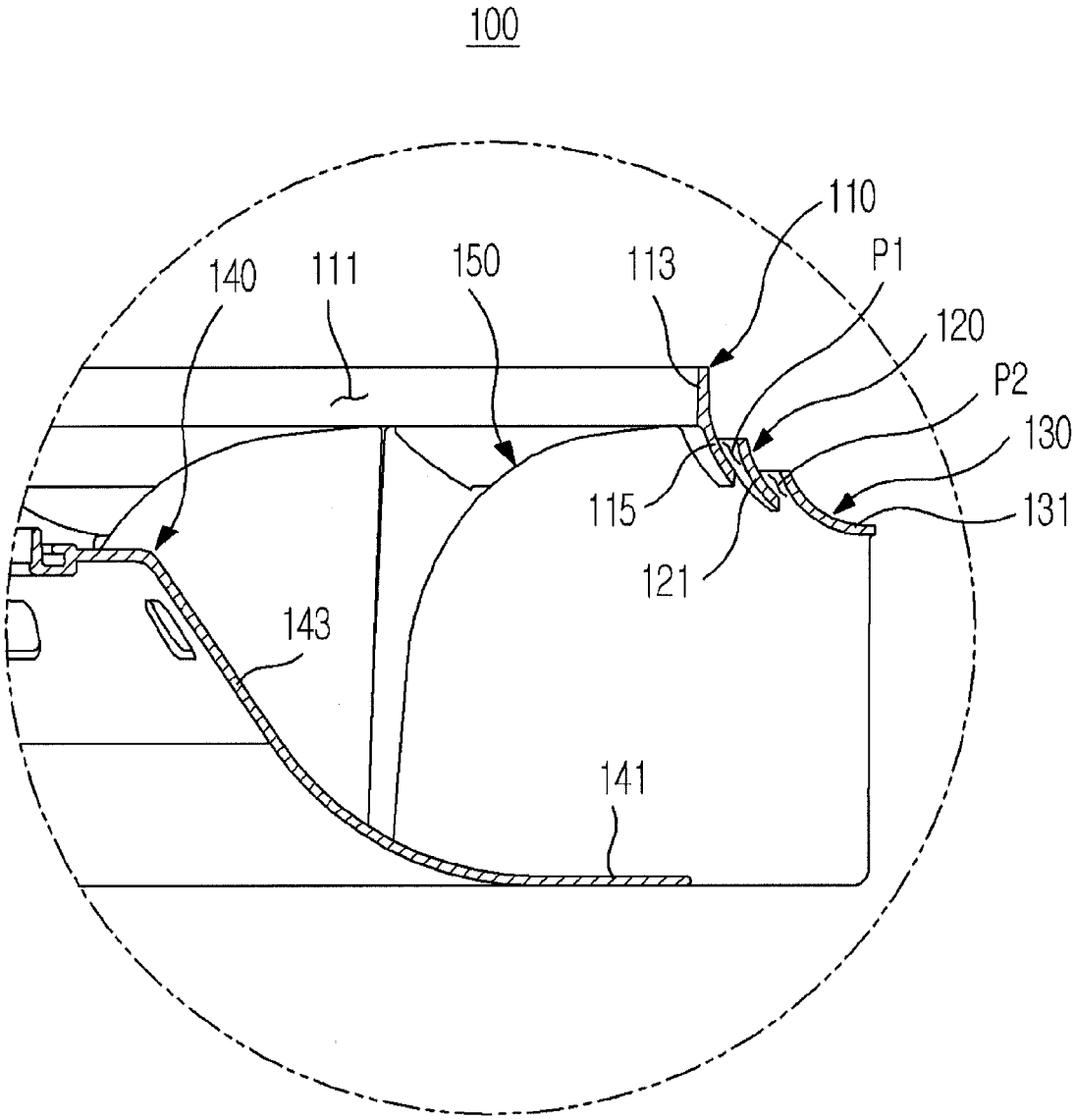
FIG. 8 is a sectional view illustrating the turbofan of the air conditioning system according to another exemplary embodiment of the present disclosure.
Figure 9A:
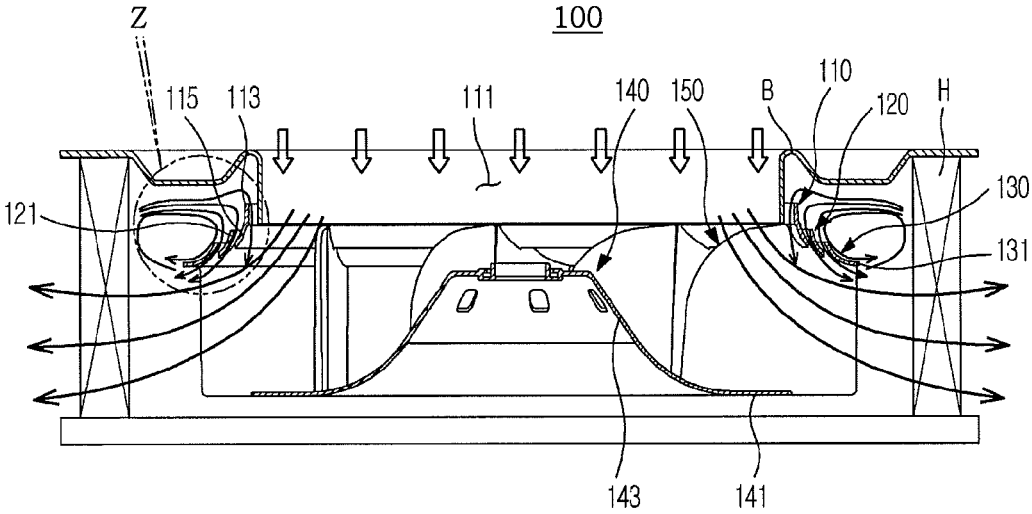
FIGS. 9A and 9B are a sectional view and an enlarged partial view "Z" illustrating an air flow in the turbofan of the air conditioning system according to another exemplary embodiment of the present disclosure.
Figure 9B:
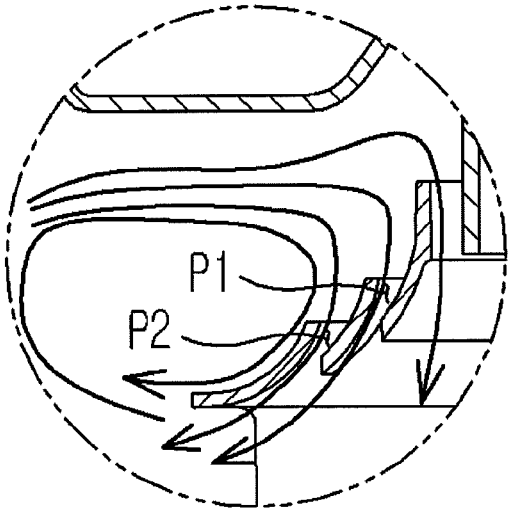

FIG. 7 is a perspective view illustrating a turbofan of an air conditioning system according to another exemplary embodiment of the present disclosure. FIG. 8 is a sectional view illustrating the turbofan of the air conditioning system according to the illustrated embodiment of the present disclosure. FIGS. 9A and 9B are a sectional view and an enlarged partial view "Z" illustrating an air flow in the turbofan of the air conditioning system according to the illustrated embodiment of the present disclosure.

As shown in FIGS. 7 to 9B, the turbofan of the air conditioning system, which is designated by reference numeral 100, includes a first shroud 110, a second shroud 120, a third shroud 130, a hub 140, and a plurality of blades 150. The first shroud 110 has a ring shape and is formed with an air inlet hole 111. The second shroud 120 is formed to be radially spaced outwards from the first shroud 110 by a predetermined clearance so that a first air passage P1 is formed between the first and second shrouds 110 and 120. The third shroud 130 is formed to be radially spaced outwards from the second shroud 120 by a predetermined clearance so that a second air passage P2 is formed between the second and third shrouds 120 and 130. The hub 140 rotates about an axis thereof through a rotational shaft (not shown) of a drive motor (not shown). The blades 150 are formed to be spaced apart from one another by a predetermined clearance along a circumferential direction of the hub 140 to guide air introduced through the air inlet hole 111 in the circumferential direction of the hub 140.

As shown in FIGS. 7 to 9B, the first shroud 110 has a ring shape. The first shroud 110 is formed, at a central area thereof, with the air inlet hole 111 having a circular shape.

Air introduced through a bell mouth B flows into the turbofan 100 of the air conditioning system through the air inlet hole 111 formed at the first shroud 110.

The first shroud 110 includes a first guide portion 113 and a second guide portion 115. The first guide portion 113 is formed in a direction perpendicular to a base 141 of the hub 140 described below to guide air introduced through the air inlet hole 111 in an axial direction of the hub 140. The second guide portion 115 is coupled to a portion of an upper surface of each blade 150 described below to guide air introduced through the air inlet hole 111 in the circumferential direction of the hub 140.

Air introduced through the air inlet hole 111 is guided in the axial direction of the hub 140 by the first guide portion 113 of the first shroud 110. Subsequently, the air guided in the axial direction of the hub 140 flows in the circumferential direction of the hub 140 by rotation of the blades 150, and is then guided to a heat exchanger H by the second guide portion 115 of the first shroud 110.

As shown in FIGS. 7 to 9B, the second shroud 120 is formed to be radially spaced outwards from the first shroud 110 by a predetermined clearance.

The second shroud 120 is formed to be spaced apart from the first shroud 110 by a predetermined clearance so that the first air passage P1 is formed at a space between the first and second shrouds 110 and 120.

The first air passage P1 has the same ring shape as the first and second shrouds 110 and 120.

The second shroud 120 includes a first inducing portion 121 corresponding to the second guide portion 115 of the first shroud 110 to define the first air passage P1 along with the second guide portion 115. The first inducing portion 121 conducts air introduced into the first air passage P1 in the circumferential direction of the hub 140.

The first inducing portion 121 included in the second shroud 120 is coupled to a portion of the upper surface of each blade 150.

As shown in FIGS. 7 to 9B, the third shroud 130 is formed to be radially spaced outwards from the second shroud 120 by a predetermined clearance.

The third shroud 130 is formed to be spaced apart from the second shroud 120 by a predetermined clearance so that the second air passage P2 is formed at a space between the second and third shrouds 120 and 130.

The second air passage P2 has the same ring shape as the second and third shrouds 120 and 130.

The third shroud 130 includes a second inducing portion 131 corresponding to the first inducing portion 121 of the second shroud 120 to define the second air passage P2 along with the first inducing portion 121. The second inducing portion 131 conducts air introduced into the second air passage P2 in the circumferential direction of the hub 140.

The second inducing portion 131 included in the third shroud 130 is coupled to a portion of the upper surface of each blade 150.

Hereinafter, the air flow in the turbofan 100 of the air conditioning system will be described with reference to FIGS. 7 to 9B.

Air introduced through the air inlet hole 111 of the first shroud 110 is guided in the axial direction of the hub 140 by the first guide portion 113 of the first shroud 110. Subsequently, the air guided in the axial direction of the hub 140 flows in the circumferential direction of the hub 140 by rotation of the blades 150, and is then guided to the heat exchanger H by the second guide portion 115, the first inducing portion 121, and the second inducing portion 131 of the respective first, second, and third shrouds 110, 120, and 130.

A portion of air to be guided to the heat exchanger H is not guided to the heat exchanger H due to various factors, for example, a difference in lengths of the heat exchanger H and each blade 150 and a position of a discharge port of the heat exchanger H, but flows toward upper portions of the first, second, and third shrouds 110, 120, and 130, thereby generating turbulent flows of air.

A portion of turbulent air generated at upper portions of the first, second, and third shrouds 110, 120, and 130 is reintroduced into a space between the bell mouth B and the first shroud 110 by a pressure difference between air rapidly introduced through the bell mouth B and the turbulent air.

The air reintroduced into the space between the bell mouth B and the first shroud 110 may disturb an air flow which is guided to the heat exchanger H after being introduced through the air inlet hole 111 of the first shroud 110. This causes generation of noise.

In order to reduce such noise, it may be necessary to reduce the amount and velocity of air reintroduced into the space between the bell mouth B and the first shroud 110.

The second shroud 120 is formed to be spaced apart from the first shroud 110 by a predetermined clearance so that the first air passage P1 is formed at the space between the first and second shrouds 110 and 120. Similarly, the third shroud 130 is formed to be spaced apart from the second shroud 120 by a predetermined clearance so that the second air passage P2 is formed at the space between the second and third shrouds 120 and 130. In accordance with such a configuration, a portion of the air reintroduced into the space between the bell mouth B and the first shroud 110 flows into the first and second air passages P1 and P2. Accordingly, it may be possible to reduce the amount and velocity of air reintroduced into the space between the bell mouth B and the first shroud 110.

In other words, the air reintroduced into the space between the bell mouth B and the first shroud 110 is partially introduced into the first and second air passages P1 and P2, so that the amount and velocity of air reintroduced into the space between the bell mouth B and the first shroud 110 may be reduced.

The air introduced into the first air passage P1 is conducted toward the heat exchanger H by the first inducing portion 121 of the second shroud 120. Similarly, the air introduced into the second air passage P2 is conducted toward the heat exchanger H by the second inducing portion 131 of the third shroud 130. As a result, the air flow is not disturbed while being guided to the heat exchanger H after being introduced through the air inlet hole 111 of the first shroud 110, thereby allowing the introduced air to flow smoothly toward the heat exchanger H.

An upper end of the first inducing portion 121 has a lower height than an upper end of the second guide portion 115. Similarly, an upper end of the second inducing portion 131 has a lower height than the upper end of the first inducing portion 121. Thus, air reintroduced into the space between the bell mouth B and the first shroud 110 may be smoothly introduced into the first air passage P1 between the first and second shrouds 110 and 120 and the second air passage P2 between the second and third shrouds 120 and 130.

Although shown with three shrouds, namely, the first, second, and third shrouds 110, 120, and 130 in the drawings, the turbofan 100 of the air conditioning system may include three or more shrouds.

Since the configurations of the hub 140 and blades 150, except for the configuration in which the first, second, and third shrouds 110, 120, and 130 are coupled with a portion of the upper surface of each blade 150, are the same as those according to the turbofan 1 of the air conditioning system shown in FIGS. 1 to 6B, no description will be given thereof.

As is apparent from the above description, a turbofan of an air conditioning system according to exemplary embodiments of the present disclosure may divide a shroud into two portions to form an air passage, in order to allow, when air is reintroduced into a space between a bell mouth and the shroud, the air to be distributed throughout the air passage, thereby achieving a reduction in noise.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A turbofan of an air conditioning system comprising:

a first shroud formed with an air inlet hole, the first shroud having a ring shape;

a second shroud formed to be radially spaced outwards from the first shroud by a predetermined clearance so that an air passage is formed between the first and second shrouds;

a hub to rotate about an axis thereof through a rotational shaft of a drive motor; and a plurality of blades formed to be spaced apart from one another by a predetermined clearance along a circumferential direction of the hub to guide air introduced through the air inlet hole in the circumferential direction of the hub, wherein each of the first and second shrouds is coupled with a portion of an upper surface of each blade.

2. The turbofan of the air conditioning system according to claim 1, wherein the first shroud comprises a first guide portion to guide air introduced through the air inlet hole in an axial direction of the hub, and a second guide portion to guide air introduced through the air inlet hole in the circumferential direction of the hub.

3. The turbofan of the air conditioning system according to claim 2, wherein the second shroud comprises an inducing portion corresponding to the second guide portion of the first shroud to define the air passage along with the second guide portion, the inducing portion conducting air introduced into the air passage in the circumferential direction of the hub.

4. The turbofan of the air conditioning system according to claim 3, wherein an upper end of the inducing portion in the second shroud has a lower height than an upper end of the second guide portion in the first shroud.

5. The turbofan of the air conditioning system according to claim 2, wherein the second shroud comprises an extending portion corresponding to the first guide portion of the first shroud to define the air passage along with the first guide portion, and an inducing portion corresponding to the second guide portion of the first shroud to define the air passage along with the second guide portion, the inducing portion conducting air introduced into the air passage in the circumferential direction of the hub.

6. The turbofan of the air conditioning system according to claim 5, wherein an upper end of the extending portion in the second shroud has the same height as an upper end of the first guide portion in the first shroud, and an upper end of the inducing portion in the second shroud has a lower height than an upper end of the second guide portion in the first shroud.

7. The turbofan of the air conditioning system according to claim 1, wherein the air passage has a ring shape.

8. The turbofan of the air conditioning system according to claim 7, wherein when air is reintroduced into the air inlet hole by turbulent flows while being guided in the circumferential direction of the hub by the blades after being introduced through the air inlet hole, a portion of the reintroduced air is introduced into the air passage formed between the first and second shrouds.

9. The turbofan of the air conditioning system according to claim 1, wherein the hub comprises a base which is coupled with a portion of a lower surface of each blade, and a protrusion portion to which the rotational shaft of the drive motor is fixed.

10. The turbofan of the air conditioning system according to claim 1, wherein each of the blades has a plate shape perpendicular to the first shroud, second shroud, and hub.

11. The turbofan of the air conditioning system according to claim 10, wherein the blade is formed to extend in a spiral direction with respect to a rotational center of the hub.

12. The turbofan of an air conditioning system according to claim 1, further comprising:

a third shroud formed to be radially spaced outwards from the second shroud by a predetermined clearance so that a second air passage is formed between the second and third shrouds.

13. The turbofan of the air conditioning system according to claim 12, wherein each of the first, second, and third shrouds is coupled with a portion of an upper surface of each blade.

14. The turbofan of the air conditioning system according to claim 13, wherein the first shroud comprises a first guide portion to guide air introduced through the air inlet hole in an axial direction of the hub, and a second guide portion to guide air introduced through the air inlet hole in the circumferential direction of the hub.

15. The turbofan of the air conditioning system according to claim 14, wherein the second shroud comprises a first inducing portion corresponding to the second guide portion of the first shroud to define the first air passage along with the second guide portion, the first inducing portion conducting air introduced into the first air passage in the circumferential direction of the hub.

16. The turbofan of the air conditioning system according to claim 15, wherein the third shroud comprises a second inducing portion corresponding to the first inducing portion of the second shroud to define the second air passage along with the first inducing portion, the second inducing portion conducting air introduced into the second air passage in the circumferential direction of the hub.

17. The turbofan of the air conditioning system according to claim 16, wherein an upper end of the second inducing portion in the third shroud has a lower height than an upper end of the first inducing portion in the second shroud.

18. The turbofan of the air conditioning system according to claim 15, wherein an upper end of the first inducing portion in the second shroud has a lower height than an upper end of the second guide portion in the first shroud.

19. The turbofan of the air conditioning system according to claim 12, wherein each of the first and second air passages has a ring shape.

20. The turbofan of the air conditioning system according to claim 12, wherein the hub comprises a base which is coupled with a portion of a lower surface of each blade, and a protrusion portion to which the rotational shaft of the drive motor is fixed.

21. The turbofan of the air conditioning system according to claim 12, wherein each of the blades has a plate shape perpendicular to the first shroud, second shroud, third shroud, and hub.

22. The turbofan of the air conditioning system according to claim 21, wherein the blade is formed to extend in a spiral direction with respect to a rotational center of the hub.

23. A turbofan of an air conditioning system comprising:

a shroud having a ring shape; a hub to rotate about an axis thereof through a rotational shaft of a drive motor; and a plurality of blades formed to be spaced apart from one another by a predetermined clearance along a circumferential direction of the hub, wherein the shroud comprises a first shroud formed with an air inlet hole, a second shroud formed to be radially spaced outwards from the first shroud by a predetermined clearance so that a first air passage is formed between the first and second shrouds, and a third shroud formed to be radially spaced outwards from the second shroud by a predetermined clearance so that a second air passage is formed between the second and third shrouds, wherein each of the first and second air passages has a ring shape, and wherein when air is reintroduced into the air inlet hole by turbulent flows while being guided in the circumferential direction of the hub by the blades after being introduced through the air inlet hole, a portion of the reintroduced air is introduced into the first air passage formed between a bell mouth and the first shroud and the second air passage formed between the first and second shrouds.

* * * * *

UNITED STATES PATENT AND TRADEMARK OFFICE

CERTIFICATE OF CORRECTION

PATENT NO. : 8,915,698 B2
APPLICATION NO. : 13/366725
DATED : December 23, 2014
INVENTOR(S) : Hyun Joo Jeon et al.

It is certified that error appears in the above-identified patent and that said Letters Patent is hereby corrected as shown below:

On the Title Page

Column 2, Item [57] (Abstract), line 5, delete “mouse” and insert -- mouth --, therefor.

Signed and Sealed this
Thirtieth Day of June, 2015

Michelle K. Lee

Michelle K. Lee
*Director of the United States Patent and Trademark Office*